US006236808B1

(12) United States Patent
Jordan et al.

(10) Patent No.: US 6,236,808 B1
(45) Date of Patent: May 22, 2001

(54) FACIAL SAUNA WITH A WATER HEATING RESERVOIR AND A FOAM RETRIEVAL RESERVOIR

(75) Inventors: Hermann Jordan, Maria Saal; Bernhard Schratter, Kalgenfurt, both of (AU)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/561,475

(22) Filed: Apr. 27, 2000

(30) Foreign Application Priority Data

Apr. 29, 1999 (EP) ..... 99890135

(51) Int. Cl.[7] ..... A61H 33/12; F02M 15/04
(52) U.S. Cl. ..... 392/403; 261/142
(58) Field of Search ..... 392/386, 390, 392/394, 398, 399, 403, 404, 405, 406; 261/139, 142, DIG. 65

(56) References Cited

U.S. PATENT DOCUMENTS 3,152,240 * 10/1964 Scott ..... 392/403
3,675,449 * 7/1972 Bluestein ..... 392/404
4,300,556 * 11/1981 Ochi et al. ..... 604/291
4,399,349 * 8/1983 Deming et al. ..... 392/403
4,903,850 * 2/1990 Frank et al. ..... 392/403
5,355,591 * 10/1994 Caruso ..... 34/60

* cited by examiner

*Primary Examiner*—Sang Paik
(74) *Attorney, Agent, or Firm*—Ernestine C. Bartlett

(57) ABSTRACT

In a facial sauna, a reservoir configuration is provided in a housing, comprising a water heating reservoir and a foam retrieval reservoir. A heating device for heating water is provided adjacent an outer region of a reservoir wall of the water heating reservoir. The reservoir configuration consists of at least two reservoir parts which are detachably connected to one another and which are separable from one another. The heating device is being provided at only one reservoir part adjacent the outer region of a reservoir wall. An inner region of the one reservoir wall of the reservoir part whose outer region lies adjacent the heating device is freely accessible when the reservoir parts are separated from one another.

7 Claims, 2 Drawing Sheets

FACIAL SAUNA WITH A WATER HEATING RESERVOIR AND A FOAM RETRIEVAL RESERVOIR

BACKGROUND OF THE INVENTION

Such a facial sauna is commercially available and is accordingly known. In the known facial sauna, a reservoir configuration is provided which comprises a base part, which forms the foam retrieval reservoir, and a water heating reservoir arranged in the region of the circumferential reservoir wall of the foam retrieval reservoir, which water heating reservoir extends substantially parallel to the circumferential wall of the foam retrieval reservoir and is connected at its side facing away from the circumferential wall of the foam retrieval reservoir to a heater plate which forms the heating device for heating the water present in the reservoir configuration, i.e. in the water heating reservoir. The problem arises in the known facial sauna that dust and other foreign particles, for example present in herbal additives and the like used in such a facial sauna, can enter the reservoir configuration. The circulation which takes place in such a reservoir configuration then leads to the situation that the dust particles and other foreign bodies are deposited mainly in the region of the reservoir wall heated by the heating device, which leads to a pollution of this reservoir wall in the form of a deposit, which in its turn causes an unpleasant odor generation when such a facial sauna is used for a longer period. This is inconvenient for a user and accordingly undesirable.

SUMMARY OF THE INVENTION

The invention has for its object to avoid the disadvantages sketched above and to provide an improved facial sauna in which the generation of an unpleasant odor can be prevented in a simple manner.

To achieve the above object, according to the invention, the measures as defined in the characterizing part of claim 1 are taken in a facial sauna as defined in the preamble of said claim.

The provision of the measures according to the invention achieves in a very simple manner and with minimum expenditure that the user of a facial sauna according to the invention can disassemble the reservoir configuration in a simple manner, preferably without any tools, and that such a disassembling operation renders the reservoir wall situated adjacent the heating device freely accessible with its inner region, so that it can be easily and thoroughly cleaned of dust particles and any other foreign bodies, whereby the generation of an unpleasant odor and the resulting inconvenience can be prevented in a simple manner.

Advantageous further embodiments of a facial sauna according to the invention are characterized by the measures as defined in the dependent claims.

The above and further aspects of the invention will become apparent from the description of an embodiment given below and are explained in more detail with reference to this embodiment.

BRIEF DESCRIPTION OF THE DRAWINGS

The invention will now be explained in more detail with reference to two embodiments shown in the drawings; however, the invention is by no means limited to these embodiments.

DESCRIPTION OF THE PREFERRED EMBODIMENTS

Figure 1:
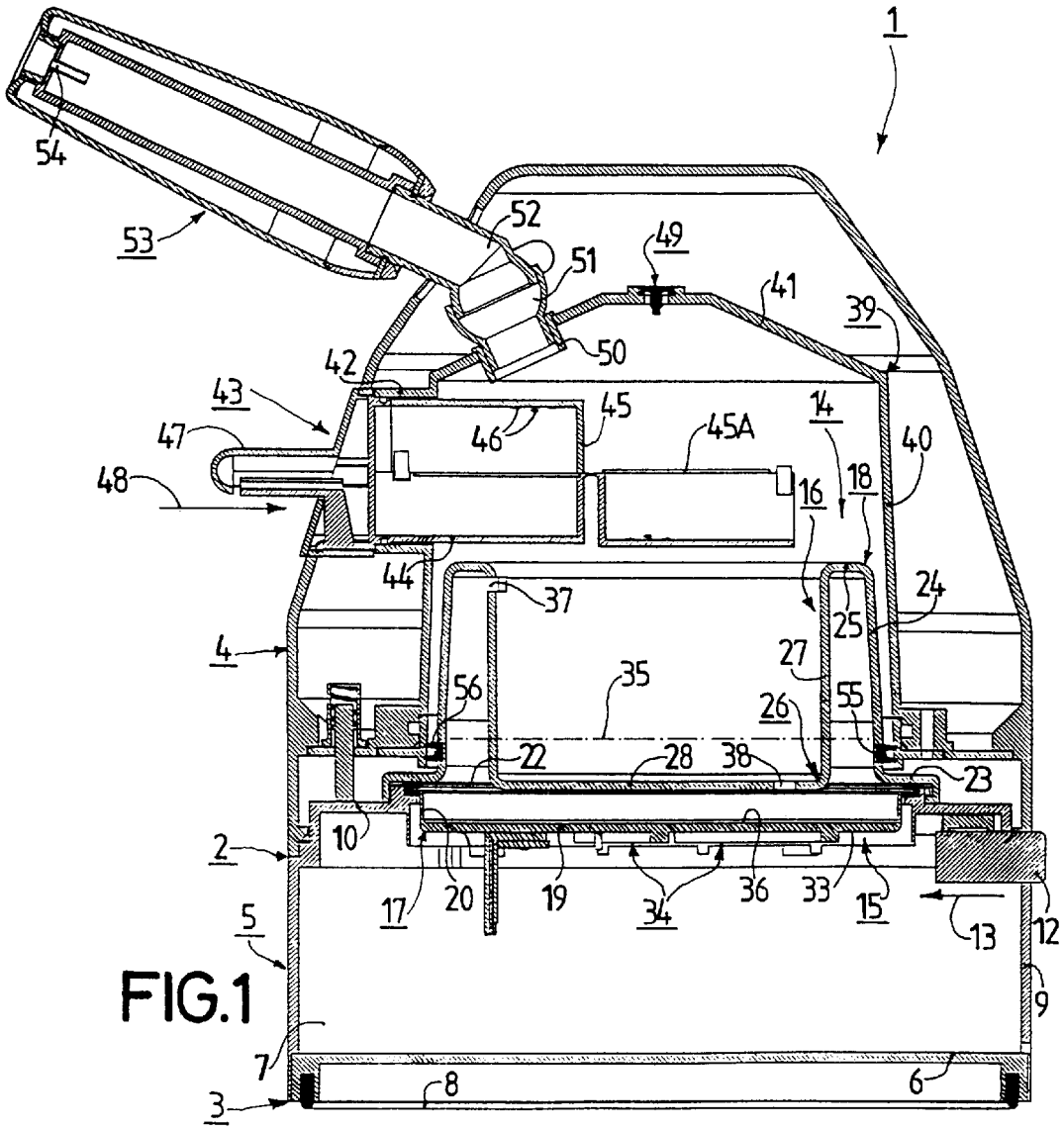
FIG. 1 is a cross-sectional view on a reduced scale of a facial sauna according to a first embodiment of the invention.

FIG. 1 shows a facial sauna 1 which is designed for generating and supplying water vapor for the treatment of facial skin. The facial sauna comprises a housing 2 which consists of a lower housing part 3 and an upper housing part 4. The lower housing part 3 comprises a chamber part 5 and a closing part 6. The closing part 6 is detachably connected to the chamber part 5 so as to provide access to an accommodation space 7 in the chamber part 5. The accommodation space 7 is designed for accommodating electric means of the facial sauna, which means are not shown in FIG. 1 for simplicity's sake because the electric means are immaterial to the present description. A rubber ring 8 is inserted into the closing part 6 of the lower housing part 3, which serves to prevent the facial sauna 1 from sliding on a table surface or any other base surface. The chamber part 5 has a side wall 9 of hollow cylindrical shape and a chamber upper wall 10 which is integrally connected to the side wall 9 and which closes off the chamber part 5 at its upper side. A passage 11 is provided in the chamber upper wall 10, as is clearly visible in FIG. 2, the purpose of which will be explained further below.

The upper housing part 4 is connected to the lower housing part 3 by locking means which are not shown. The upper housing part 4 can be removed from the lower housing part 3. To enable such a removal, an unlocking button 12 is provided in the lower housing part 3, which can be operated manually by a user in the direction of an arrow 13 and which upon such an operation provides an unlocking of the locking means mentioned above, whereupon the upper housing part 4 can be taken off the lower housing part 3.

The facial sauna 1 comprises a reservoir configuration 14 accommodated in the housing 2 and comprising a water heating reservoir 15 and a foam retrieval reservoir 16. Advantageously, the construction of the reservoir configuration 14 in the facial sauna 1 is such that the reservoir configuration 14 consists of two reservoir parts, i.e. of a base part 17 and a cover part 18. The two reservoir parts 17 and 18 are detachably connected to one another and can accordingly be separated from one another. The base part 17 bounds the water heating reservoir 15 at the lower side. The cover part 18 contains the foam retrieval reservoir 16.

Figure 2:
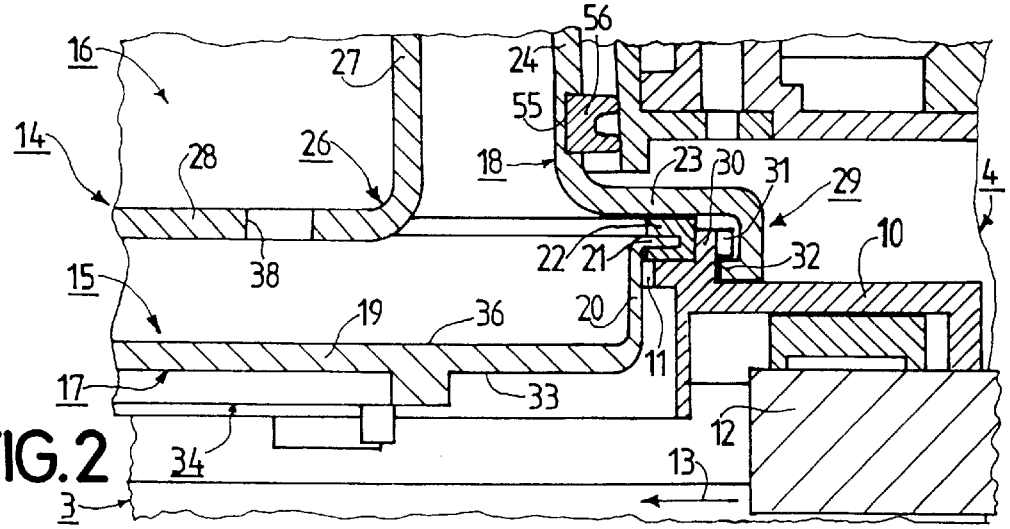
FIG. 2 shows part of the facial sauna of FIG. 1 on a larger scale than in FIG. 1.

The base part 17 has a bottom wall 19 and a hollow cylindrical side wall 20 which projects from the bottom wall 19 in the direction of the cover part 18, as well as an annular base flange 21 which extends parallel to the bottom wall 19, as is apparent from FIG. 2. It is clearly visible in FIG. 2 as well that an annular sealing 22 of U-shaped cross-section is provided over the base flange 21 of the base part 17.

The cover part 18 comprises an annular cover edge 23 which runs parallel to the bottom wall 19 and to the base flange 21 of the base part 17 and which lies directly against the annular sealing 22 in the present case, when the reservoir parts 17 and 18 are joined together. Alternatively, however, the cover edge 23 may lie indirectly on the sealing 22, in which case an intermediate ring may lie between the cover edge 23 and the sealing 22. The cover part 18 further comprises a sleeve portion 24 which is integral with the annular cover edge 23, which extends away from the base part 17, and which has a slightly narrowing shape in a direction away from the base part 17. The cover part 18 comprises a top portion 25, which is integral with the sleeve portion 24 and which extends from the sleeve portion 24 towards the center of the cover part 18, in the end region of the cover part 18 remote from the cover edge 23. The cover part 18 further comprises a container portion 26, which forms the foam retrieval reservoir 16, which is integrally joined to the top portion 25, and which extends from the top portion 25 towards the base part 17. The container portion 26 here consists of a side wall 27 and a bottom wall 28.

The base part 17 is laid with its base flange 21 on the chamber upper wall 10, with the sealing 22 being interposed therebetween, such that the base part 17 is passed with its side wall 20 through the passage 11 in the chamber upper wall 10, so that the bottom wall 19 of the base part 17 projects into the accommodation space 7 of the lower housing part 3. The cover part 18, as noted above, lies with its cover edge 23 on the sealing 22. A so-called bayonet closure 29 is provided for a detachable connection of the two reservoir parts 17 and 18 in the facial sauna 1, which closure acts between the chamber upper wall 10 and the cover part 18. The bayonet closure 29 for this purpose comprises locking studs 31 projecting in radial direction from a hollow cylindrical projection 30 extending from the chamber upper wall 10, and furthermore locking hooks 32 which are integrally connected to the cover edge 23 and behind whose radially inward-projecting free ends the locking studs 31 can engage. The bayonet closure 29 can be unlocked in a known manner through a rotation of the cover part 18 with respect to the base part 17, i.e. with respect to the chamber upper wall 10, through a given angle of rotation, so that the two reservoir parts 17 and 18, i.e. the base part 17 and the cover part 18, can be separated from one another.

Adjacent to an outer region of at least one reservoir wall of the water heating reservoir 15, in the present case adjacent to the outer region 33 of the bottom wall 19 of the base part 17 of the container configuration 14, the facial sauna 1 comprises a heating device 34, indicated diagrammatically only in FIG. 1, for the purpose of heating water present in the base part 17 and thus in the water heating reservoir 15, the maximum admissible water level thereof being indicated with a dash-dot line 35 in FIG. 1. The heating device 34 is formed by a resistance heating device realized in the form of so-called PTC elements which are known per se. The construction of the facial sauna 1 is advantageously chosen to be such that the heating device 34 is arranged adjacent to the outer region of at least one reservoir wall in one reservoir part only, i.e. adjacent to the outer region 33 of the bottom wall 19 of the base part 17 in this base part 17 only. Furthermore, the construction of the facial sauna 1 is advantageously chosen to be such that, when the reservoir parts 17 and 18 are separated from one another, i.e. when the cover part 18 is separated from the base part 17, the inner region 36 of the bottom wall 19 of the base part 17, close to whose outer region 33 the heating device 34 is situated, is freely accessible.

It is also to be noted that the water heating reservoir 15 and the foam retrieval reservoir 16 are in communication with one another through a foam return passage provided in a reservoir wall and through at least one water return passage provided in a reservoir wall. In the present case, a foam return passage 37 is provided in the side wall 27 of the container portion 26 of the cover part 18, which passage is formed by a narrow slit which cuts in tangential direction through the side wall 27. Furthermore, a water return passage 38 is provided in the bottom wall 28 of the container portion 26 of the cover part 18, which passage is formed by a simple hole of circular cross-section. Instead of a passage cutting through the side wall 27 as the foam return passage 37, a passage provided in the top portion 25 of the cover part 18 may alternatively be present, which may in addition be used as a draining spout, if so desired.

It is to be noted, furthermore, that a vapor collector dome 39 is accommodated in the upper housing part 4 and is retained in a manner not described in any detail. The vapor collector dome 39 has a substantially hollow cylindrical side wall 40 and a dome-shaped upper wall 41 which is integrally connected to the side wall 40. The vapor collector dome 39 is provided with a connector 42 in the region of the side wall 40. The connector 42 is designed for retaining a so-called additive container 43. The additive container 43 has a tub-shaped bottom part 44 and a hollow cover part 45, which cover part 45 is provided with passages 46 through which odoriferous substances and the like can enter the interior of the vapor collector dome 39. The additive container 43 is provided with a handle 47 by means of which the additive container 43 can be inserted into the connector 42 of the vapor collector dome 39 in the direction of an arrow 48 and can be pushed home through the connector 42. When the additive container 43 has been pulled from the vapor collector dome 39 in a direction opposed to the arrow 48, the upper container part 45 can be pivoted with respect to the tub-shaped bottom part 44 into an open position, which is shown in FIG. 1 and referenced 45A. It should be expressly noted once more that the position of the cover part 45 referenced 45A is possible only when the additive container 43 is outside the facial sauna 1, for the purpose of refilling the additive container 43. It should further be noted that an additive container which has no cover part may alternatively be present.

A pressure relief valve 49 is provided in the upper wall 41 of the vapor collector dome 39, which represents an advantageous safety measure.

A fastening sleeve 50 is connected to the upper wall 41 of the vapor collector dome 39. A first intermediate piece 51 is connected to the fastening sleeve 50, and a second intermediate piece 52 is connected to the first, said connection between the first intermediate piece 51 and the second intermediate piece 52 being constructed such that the second intermediate piece 52 can be pivoted with respect to the first intermediate piece 51 in all directions within a certain pivoting range. A vapor outlet device 53 is connected to the second intermediate piece 52 and has a vapor outlet nozzle 54 at its free end.

A recess 55 (see FIG. 2) is provided in the region of the sleeve portion 24 so as to achieve a perfect sealing between the sleeve portion 24 of the cover part 18 of the reservoir configuration 14 and the side wall 40 of the vapor collector dome 39 and accordingly to avoid an undesirable escape of water vapor from the vapor collector dome 39. A rubber gasket 56 is inserted into the recess 55, which gasket has a substantially U-shaped cross-section and which lies with its free ends against the side wall 40.

During operation of the facial sauna 1, the water present in the water heating reservoir 15 is heated by the heating device 34 to such a high temperature that water vapor is generated. The generated water vapor is conducted through the foam return passage 37, which is also designed for the passage of foam, into the interior of the vapor collector dome 39, the generated water vapor being enriched with aromatic substances and the like present in the additive container 43. After that, the generated water vapor is transported through the first intermediate piece 51 and the second intermediate piece 52 to the vapor outlet device 53, so that the generated water vapor passes through the vapor outlet nozzle 54 and can be applied to the skin of a human face.

After the facial sauna 1 has been used several times, it is possible for foam to be formed in the region of the water heating reservoir 15 of the reservoir configuration, which is essentially caused by the fact that particles undesirably enter the water present in the water heating reservoir 15, which particles cause a foam generation when the water is heated. For example, these particles may be formed by dust particles, or alternatively by particles of additives present in the additive container 43. If such a foam generation occurs, the result will be that the generated foam rises between the sleeve portion 24 and the side wall 27 of the cover part 18 up to the top portion 25, whereupon the foam will pass through the foam return passage 37 into the interior of the container portion 26. The pressure with which the foam is forced through the foam return passage 37 and the temperature prevailing in the container portion 26, which is lower than the temperature in the water heating reservoir 15, will cause the generated foam to be changed into water again, which then flows through the water return passage 38 back into the water heating reservoir 15 again.

The upper housing part 4 of the facial sauna 1 can be removed from the lower housing part 3 in a simple manner through the operation of an unlocking button 12, upon which removal the vapor collector dome 39 is pulled with its side wail 40 from the gasket 56. After the upper housing part 4 has been removed in this manner, the cover part 18 of the reservoir configuration 14 is freely accessible. The cover part 18 may then be slightly rotated by hand, which has the result that the bayonet device 29 is unfastened, whereupon the cover part 18 can be separated from the base part 17. After such a separation of the cover part 18 from the base part 17, the inner region 36 of the bottom wall 19 of the base part 17, whose outer region 33 is closely adjacent to the heating device 34 of the facial sauna 1, is advantageously freely accessible. This offers the major advantage that the container wall adjoining the heating device 34, i.e. the bottom wall 19 of the base part 17, can be thoroughly cleaned in a simple manner. This is particularly advantageous because dirt particles or additive particles can enter the reservoir configuration 14 during operation of the facial sauna 1, in which case such particles may become deposited against the bottom wall 19 adjoining the heating device 34, which would lead to an unpleasant odor generation and a resulting odor nuisance if cleaning of the bottom wall 19 of the base part 17 were not possible. Such a disadvantageous odor nuisance is prevented in a simple manner in the facial sauna 1 by the simple cleaning possibility.

Figure 3:
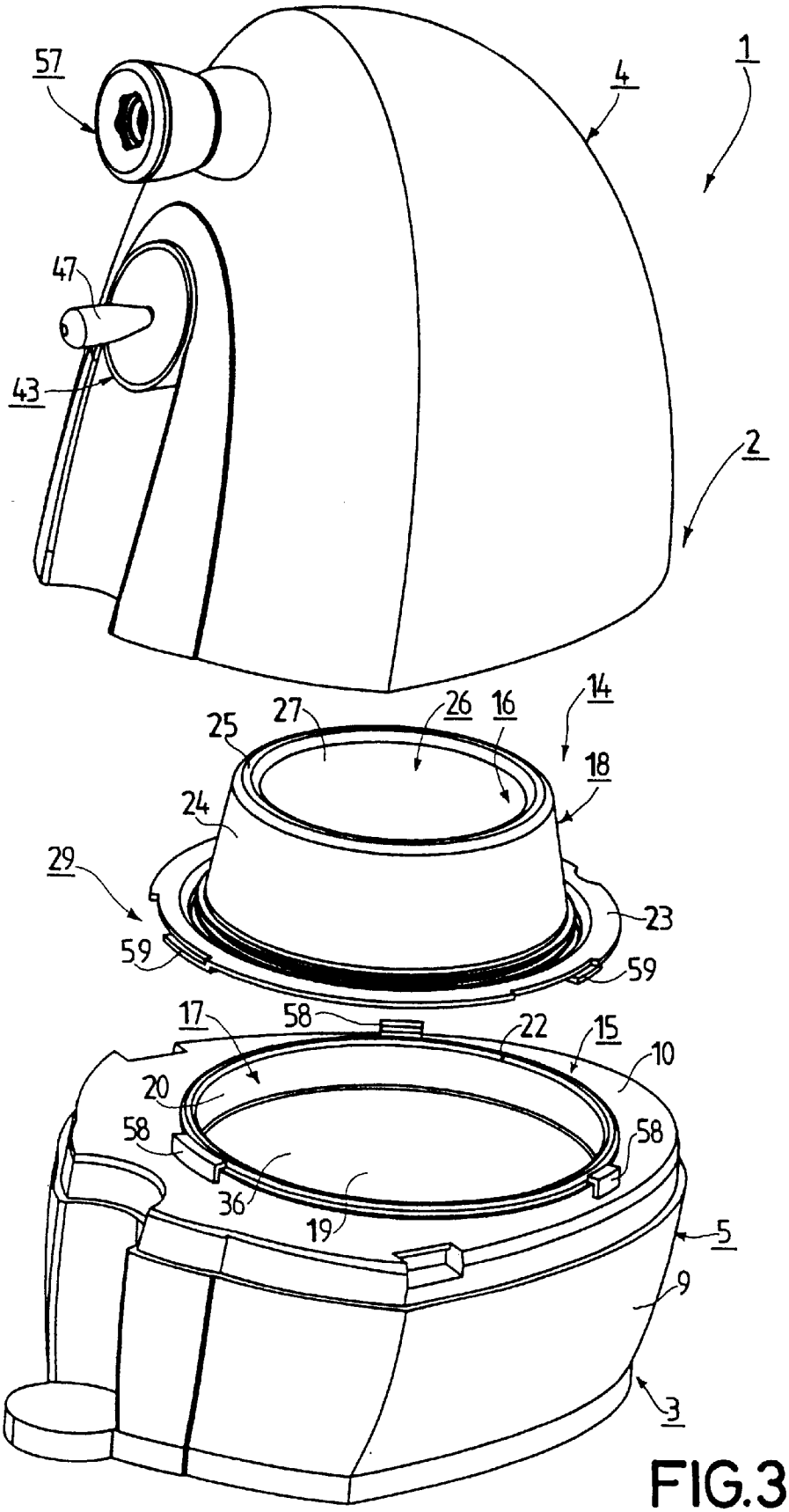
FIG. 3 is an exploded view of a facial sauna in a second embodiment of the invention viewed obliquely from above.

FIG. 3 shows a facial sauna 1 in which the advantages explained above are also safeguarded. The facial sauna 1 of FIG. 3 has a different housing construction than the facial sauna 1 of FIGS. 1 and 2 and is provided with a vapor outlet device 57 of different design. It should also be noted with reference to the facial sauna 1 of FIG. 3 that the bayonet device 29 in this facial sauna 1 is of a different construction, i.e. the bayonet device 29 is active between the cover part 18 and the base part 17, the base part 17 having three locking hooks 58 which project outwards in radial directions, and the cover part 18 having three locking tags 59 for cooperating with said locking hooks 58.

The invention is not limited to the two embodiments described above. For example, an annular heating device may alternatively be provided in a facial sauna, arranged adjacent a hollow cylindrical side wall of a base part, in which case a simple cleaning of the interior of the hollow cylindrical side wall of the base part is safeguarded in that the measures according to the invention are taken.

What is claimed is:

1. A facial sauna, which is designed for generating and delivering water vapor for the treatment of facial skin and comprises a housing, which comprises a reservoir configuration provided in the housing and comprising a water heating reservoir and a foam retrieval reservoir, wherein a heating device for heating water present in the water heating reservoir is provided adjacent an outer region of at least one reservoir wall of the water heating reservoir, and wherein the water heating reservoir and the foam retrieval reservoir are in communication with one another through at least one foam return passage provided in a reservoir wall and through at least one water return passage provided in a reservoir wall, wherein the reservoir configuration consists of at least two reservoir parts which are detachably connected to one another and can be separated from one another, in that the heating device is provided at only one reservoir part adjacent to the outer region of at least one reservoir wall, and in that an inner region of the at least one reservoir wall (19) of the reservoir part, whose outer region adjoins the heating device, is freely accessible when the reservoir parts are separated from one another.

2. A facial sauna as claimed in claim 1, wherein the reservoir configuration comprises a base part and a cover part, in that the base part at its lower side bounds the water heating reservoir, and in that the cover part comprises the foam retrieval reservoir.

3. A facial sauna as claimed in claim 2, wherein the heating device is arranged adjacent the outer region of the bottom wall of the base part.

4. A facial sauna as claimed in claim 2, wherein the base part comprises an annular base flange which extends parallel to the bottom wall thereof, in that an annular sealing which is U-shaped in cross-section is provided on the base flange of the base part, and in that the cover part comprises an annular cover edge which extends parallel to the bottom wall of the base part and bears on the annular sealing when the reservoir parts are joined together.

5. A facial sauna as claimed in claim 4, wherein the cover part comprises a sleeve portion which is integrally connected to the annular cover edge and extends away from the base part, and comprises a top portion which is integrally connected to the sleeve portion at its end region facing away from the cover edge and extends from the sleeve portion towards the center of the cover part, and comprises a container portion which is integrally connected to the top portion and extends from the top portion to the base part, which container portion forms the foam retrieval reservoir.

6. A facial sauna as claimed in claim 5, wherein the at least one foam return passage is provided in the side wall of the container portion of the cover part.

7. A facial sauna as claimed in claim 5, wherein the at least one water return passage is provided in the bottom wall of the container portion of the cover part.

* * * * *